United States Patent [19]

Yokoi et al.

[11] 4,257,048

[45] Mar. 17, 1981

[54] ANTENNA SYSTEM TO REDUCE FADING CAUSED BY MULTIPATH TRANSMISSION

[75] Inventors: Hiroshi Yokoi, Machida; Takayasu Shiokawa, Yokohama, both of Japan

[73] Assignee: Kokusai Denshin Denwa Kabushiki Kaisha, Tokyo, Japan

[21] Appl. No.: 882,247

[22] Filed: Feb. 28, 1978

Related U.S. Application Data

[63] Continuation of Ser. No. 614,959, Sep. 19, 1975, abandoned.

[30] Foreign Application Priority Data

Sep. 28, 1974 [JP] Japan ..... 49/11822

[51] Int. Cl.[3] ..... H01Q 1/34; H01Q 3/28

[52] U.S. Cl. ..... 343/709; 343/766; 343/854

[58] Field of Search ..... 343/100 LE, 854, 709, 343/710, 765, 766

[56] References Cited

U.S. PATENT DOCUMENTS

| | | | |
|---|---|---|---|
| 3,435,453 | 3/1969 | Howard | 343/854 |
| 3,876,947 | 4/1975 | Giraudon | 343/854 |
| 3,881,177 | 4/1975 | Len et al. | 343/854 |

*Primary Examiner*—Eli Lieberman

*Attorney, Agent, or Firm*—Robert E. Burns; Emmanuel J. Lobato; Bruce L. Adams

[57] ABSTRACT

An antenna system including a single directional antenna having a single directional gain pattern for receiving electromagnetic waves in a certain direction. The orientation of the directional gain pattern is varied to vary the gain of the antenna in directions other than the certain direction in which electromagnetic waves are to be received. The gain is varied at a frequency higher than that of amplitude variations superimposed on the received electromagnetic waves while maintaining the gain substantially constant in the certain direction in which electromagnetic waves are to be received. The antenna gain variations in the directions other than the certain direction are effective to reduce the amplitude of received undesired electromagnetic waves and thereby diminish amplitude variations caused by these undesired electromagnetic waves.

13 Claims, 19 Drawing Figures

ANTENNA SYSTEM TO REDUCE FADING CAUSED BY MULTIPATH TRANSMISSION

This is a continuation of application Ser. No. 614,959, filed Sept. 19, 1975, now abandoned.

FIELD OF THE INVENTION

This invention relates to an antenna system which is adapted to alleviate fading caused mainly by unnecessary electric waves included in incoming waves, that is, by multipath transmission.

BRIEF DESCRIPTION OF THE PRIOR ART

There has heretofore been employed such a system as space diversity or frequency diversity for alleviating fading of received electric waves. The space diversity system is a system in which a plurality of antennas are disposed at intervals of more than several wavelengths, and the frequency diversity system is a system which employs a plurality of frequency bands whose center frequencies differ from one another to some extent. These conventional systems utilize non-correlation of fading among the plurality of received waves and obtain the diversity effect (1) by selective reception of a higher intensity one of received waves, (2) by combining the received signals with each other to provide a composite signal after detecting them, (3) by switching the received waves at a high speed and (4) by combining the received waves with each other after making them in phase. (For example, refer to "Studies on Characteristics of Short Waves and Diversity Reception of the Same", by Nakagami, published by Shukyosha; Japanese Patent Publication No. 14995/1952 "Diversity Reception System"; "Theory of Frequency Diversity Effect" by Nakagami & Wakana, Mass Meeting of Kansai Branches of Three Societies of Electricity, 1952.)

Further, for the alleviation of fading caused by reflected waves from the surface of the sea in a maritime propagation path, there has heretofore been adopted a system which employs a plurality of antennas and in which a distance between the antennas and the number of antenna elements are selected so that the composite directivity to the surface of the sea becomes zero. (For example, refer to "Propagation of Micro Waves on the Sea and Reflected Wave Preventing Antenna", Tsukenjippo, Vol. 8, No. 5, 1959). However, in maritime communication, maritime radio wave relay and land vehicle communication, in the case of using space diversity or the countermeasure for preventing reflecting waves from the surface of the sea such as described above, a plurality of antenna apparatuses cannot be often prepared because of a limitation on the place of installation of communication apparatus and from the economical point of view.

BRIEF DESCRIPTION OF THE DRAWINGS

The principle, construction and operation of this invention will be clearly understood from the following detailed description taken in conjunction with the accompanying drawings, in which.

For convenience of explanation, the following description will be given in connection with a case of an antenna for ship stations in maritime satellite communication on the assumptions, that the frequency of an employed electric wave is included in the microwave frequency band, that the gain of a ship borne antenna is of about 20 dB, and that the lower limit of the elevation angle of the antenna to the satellite is about 10°.

Figure 1:
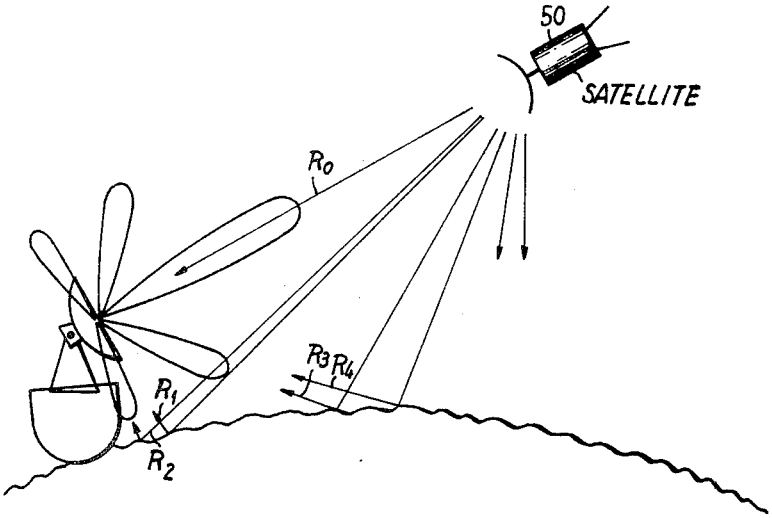
FIG. 1 is a diagram illustrating an electric wave transmission system to which this invention is applied.

As shown in FIG. 1, an electric wave $R_0$ is directly received from the satellite 50 and, electric waves $R_1$, $R_2$, $R_3$ . . . are received after being reflected from the sea surface usually through antenna side lobes. As illustrated in FIG. 1, many reflected waves come from a wide area on the sea surface between the antenna and the horizon but the electric waves which are received by the ship borne antenna are restricted only to those reflected from the sea surface within the area to which the antenna beam is directed. Since the sea surface is generally a complicated, irregular and momentarily fluctuating surface, there exist a great number of received waves reflected from the sea surface, so that the composite electric field vector of these waves always undergoes irregular fluctuations in its phase and amplitude owing to the everlasting fluctuations of the surface of the sea and the sailing movement of the ship. The fluctuating electric waves reflected from the sea surface are superimposed on the electric wave $R_0$ directly coming from the satellite 50, whereby the so-called fading is caused.

This invention is directed to an antenna system which is adapted to obtain the diversity effect by varying the directivity pattern of a single antenna having only one radiation pattern with the necessary directivity to receive electromagnetic waves in a certain direction, taking advantage of the fact that fading of a composite signal of the sea surface reflected components $R_1$, $R_2$, $R_3$, . . . of the electric waves coming from the satellite and that of a composite signal of components $R'_1$, $R'_2$, $R'_3$, . . . obtained when the antenna pattern is varied to have no correlation with each other. An embodiment of this invention is shown in FIG. 2.

Figure 2:
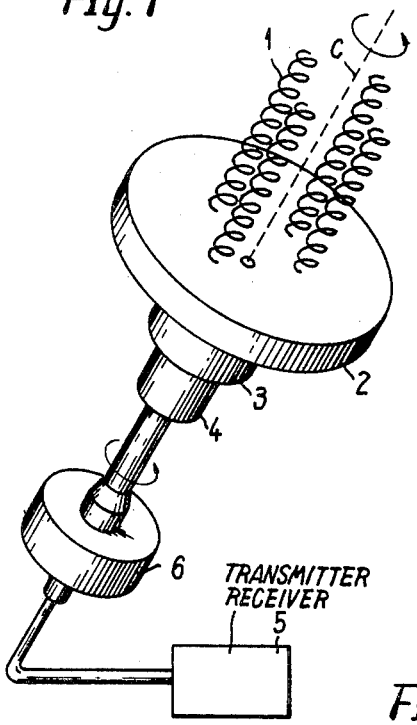
FIG. 2 is a perspective view illustrating an example of this invention.

Namely, in FIG. 2, reference numeral 1 indicates antenna elements which are fixed to a reflector 2 at positions symmetrical with respect to the central axis C of the reflector 2; 3 designates a matching box; 4 identifies a rotary joint; 5 denotes a transmitter-receiver; and 6 represents a driving motor. As is apparent from FIG. 2, the present example is designed so that the reflector 2 having fixedly mounted thereon the antenna elements 1, which are suitable to be loaded on a moving vehicle, small in size and excellent in directivity, is rotated about the axis of rotation C.

Figure 3:
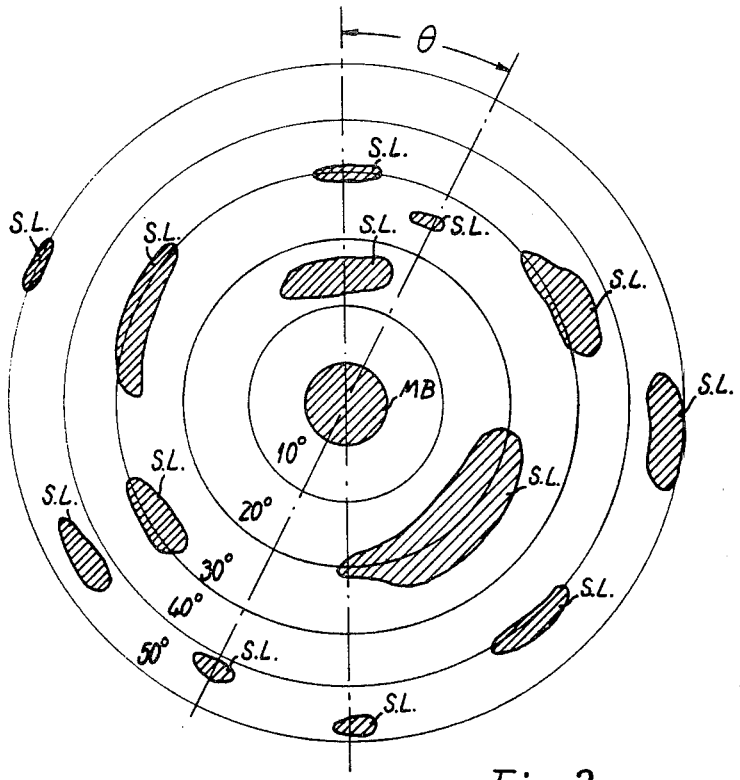
FIG. 3 is a diagram illustrating an example of a directivity pattern of the example shown in FIG. 2.
Figure 4A:
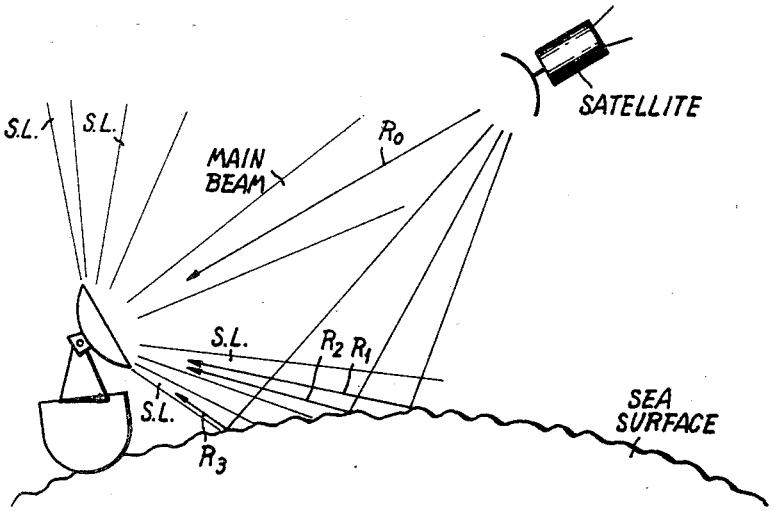
FIGS. 4A and 4B are diagrams showing electric wave transmission systems explanatory of the operation of an antenna according to this invention.
Figure 4B:
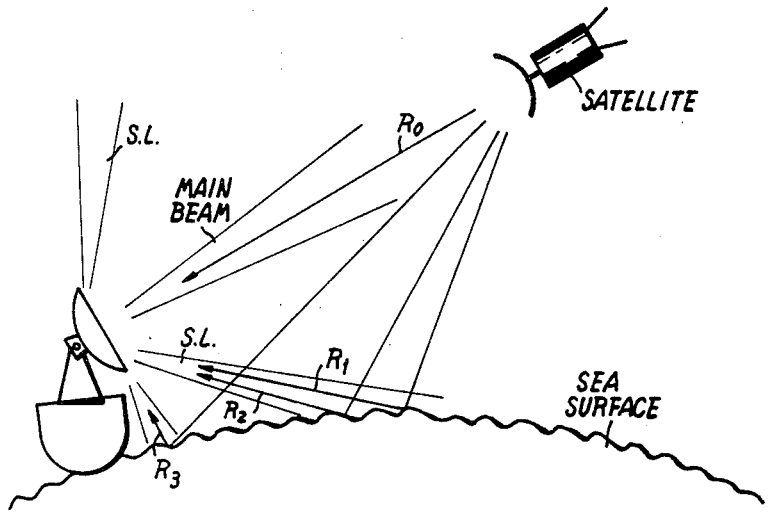

Generally, the radiation characteristic of the single antenna having only one radiation pattern includes a main beam or main lobe MB at the center thereof and side lobes SL around the main beam MB, as shown in FIG. 3. The main lobe defines a direction of maximum gain, and the side lobes are oriented in directions other than the direction of maximum gain. References 10°, 20°, 30°, . . . indicate concentric circles about the same center at the beam center axis. Accordingly, if the antenna is rotated by an angle $\theta$ under a condition where the necessary directivity in a certain direction to receive electromagnetic waves is maintained at a substantially constant gain value, the level and the region in which the side lobes of the antenna irradiate the surface of the sea vary as shown in FIG. 4. Namely, if FIG. 4A is assumed to show the state of receiving electric waves before the rotation of the reflector 2, FIG. 4B shows the state of reception after the rotation of the reflector 2 by the single $\theta$. As is seen from FIGS. 4A and 4B, the rotation of the antenna about the beam center axis by the angle $\theta$ causes a change in the instantaneous phase and amplitude of the electric waves received by the side lobes SL so that the gain of the single antenna in the direction of undesired electromagnetic waves is varied. Consequently, if the rotational angle $\theta$ is larger than a certain value, a correlation between fading of the electric waves received in the state of FIG. 4A and that of the electric waves received in the state of FIG. 4B is very small. In this case, since characteristics of fading of the electric waves of both cases are generally regarded as substantially statistically the same as each other, if the accumulation probability that the received levels of the both electric waves will be lower than a certain level R is taken as a value P(R), the accumulation probability that the both will be lower than the level R is approximately a value $\{P(R)\}^2$, which is extremely smaller than the P(R). In this case, by switching the respective outputs of two antennas or of different frequencies from a single antenna, though this is conventional switching diversity, or in other words by rotating only one antenna at high speed higher than a certain value as described later, the same effect obtainable with the switching diversity employing $360°/\theta$ antennas or frequencies can be obtained.

Figure 5:
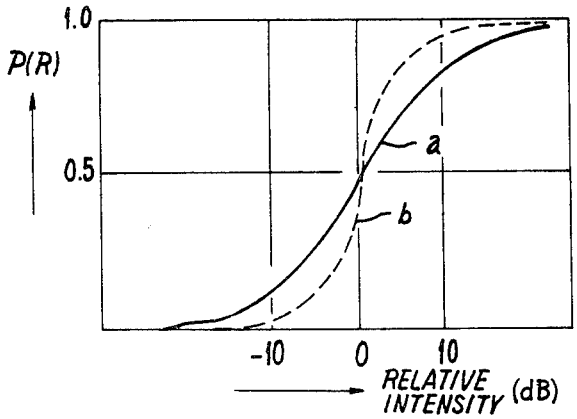
FIG. 5 is a characteristic diagram illustrating receiving characteristics of a conventional antenna and an antenna of this invention in an electric wave transmission system affected by multipath transmission.

In general, the accumulation probability P(R) that a value of the composite received voltage under multipath transmission will exceed the certain value R has such a distribution as indicated by the solid line curve a in FIG. 5. In FIG. 5, the abscissa represents the relative intensity, that is, the intensity evaluated by the mean square value of the received voltage. Accordingly, in a case where the antenna is rotated about the beam axis as described previously, the value of the accumulation probability P(R) varies as indicated by the broken line curve b, so that level fluctuation decreases in comparison with that in case of no rotation of the antenna and receiving characteristics of excellent signal to noise ratio can be obtained. In this case, if the mean period of fading due to the variation of the surface of the sea is taken as T seconds and if the correlation of the reflected waves is assumed to become zero at the rotational angle $\theta$, the rotating speed N of the antenna may be $$N > \frac{\theta}{4\pi T}$$

($\pi$: the ratio of the circumference of a circle to its diameter) under the sampling theorem if the incoming waves are nonmodulated waves. As the number of rotations increases, the resulting effect is enhanced more and more. However, since the period of fluctuation of the surface of the sea is not so short, the abovesaid effect can be sufficiently produced with relatively low-speed rotation of the antenna. Further, in a case where the incoming wave is modulated by a modulation signal and the period of the modulated signal is shorter than the fading period, it is necessary to satisfy a condition: $N > \theta/4\pi T'$, where T' is the period of the modulated signal corresponding to T in the abovesaid equation. Accordingly the gain of the single antenna is varied in the directions of undesired electromagnetic waves at a frequency (1/N) higher than the frequency of a modulation signal (1/T') transmitted on a carrier wave to be received by the antenna.

Figure 6:
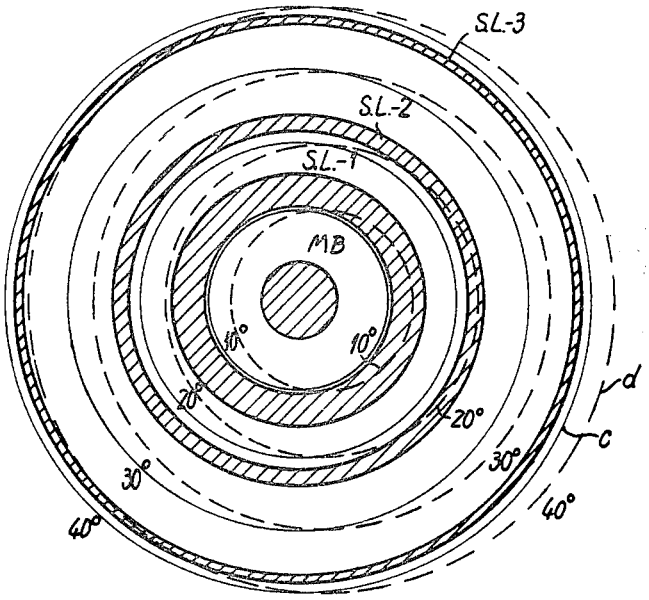
FIG. 6 is a diagram illustrating a directivity pattern of another antenna to which this invention is applied.

The foregoing description has been given in connection with an ordinary antenna which has such a beam characteristic as shown in FIG. 3, in which the side lobes are non-uniformly distributed about the main beam MB. Next, a description will be made of a case where the antenna radiation characteristic has an ideal axis-symmetry characteristic, so that side lobes S.L-1, S.L-2 and S.L-3 lie with practically no break on concentric circles about the main beam MB as shown in FIG. 6. In this case, the abovesaid effect cannot be obtained with the same operation as described above.

Figure 7:
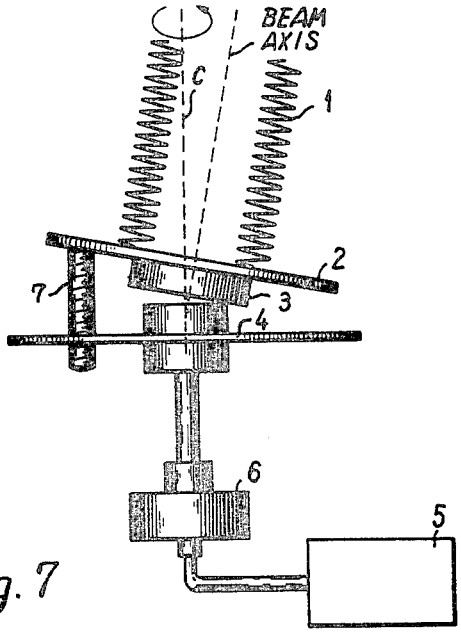
FIG. 7 is a side view illustrating another example of this invention.

Turning now to FIG. 7, another example of this invention will be described. In FIG. 7, reference numerals 1 to 6 indicate the same parts as those in FIG. 2, and 7 designates an axis inclining spacer for rotating the antenna about the axis of rotation C which is slightly inclined with respect to the original beam direction. In the present example, the reflector 2 is rotated with the rotation of the driving motor 6, and this rotation of the reflector is achieved so that the antenna beam may rotate at an oblique angle about the center of rotation C due to the spacer 7. Thus, the concentric circles about the center axis of the radiation pattern, which are symmetrical with respect to the axis as indicated by solid lines c in FIG. 6, become eccentric with respect to the axis of rotation C of the antenna as indicated by broken lines d. Namely, the distribution of the main beam and the side lobes is not uniform in a desired direction that is in the direction of the axis of rotation. This can be achieved by the utilization of the following fact. That is, the beam width of the main beam is generally much larger than the beam width of the side lobe, and a decrease in its gain is very small if the axis is slightly inclined but the level of the side lobe is greatly changed by the slight inclination of the axis. In this case, the first and second side lobes S.L-1, and S.L-2 are mainly affected by reflection from the surface of the sea, so that the resulting effect is substantially the same as the example shown FIG. 2.

Figure 8A:
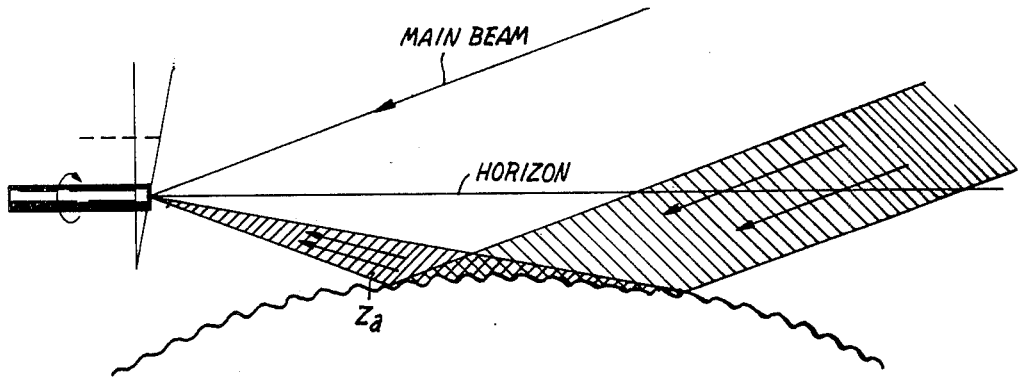
FIGS. 8A and 8B are diagrams explanatory of the operation of another example of this invention.
Figure 8B:
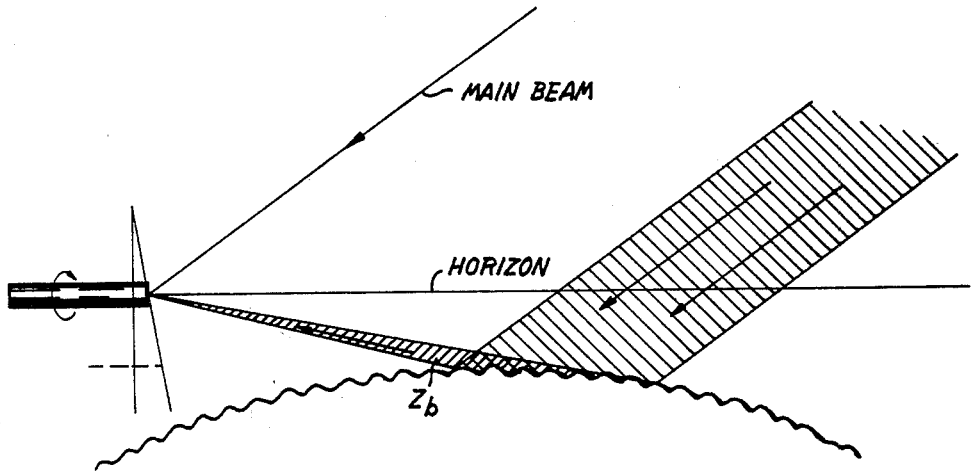

Further, even where one part of the main beam irradiates the surface of the sea or the ground and instantaneously fluctuated waves are reflected therefrom, if the irradiation level of the antenna beam is slightly varied by slightly inclining the axis of the antenna to thereby shift regions Za and Zb in the direction in which the waves are reflected from the surface of the sea as shown in FIGS. 8A and 8B, the phases and the amplitudes of undersirable waves received by the antenna are forcibly varied and, as a result of this, the same fading reduction effect as described above can be obtained. Also in this case, it is a matter of course to rotate the antenna at a speed appreciably higher than the variation period of fading and so on.

The above description has been given with regard to the case where the antenna beam is rotated about its axis or an axis slightly inclined with respect thereto, but the effect of alleviating the abovesaid undesirable electric waves can also be obtained by repeatedly shifting the antenna at a high speed in a vertical or horizontal direction. This is obtained by the following fact. Namely, as will be readily seen from FIGS. 8A and 8B, since the region of irradiation of the surface of the sea can also be displaced by shifting the antenna, the composite amplitudes and phases of the received waves reflected from the surface of the sea can be made non-correlative with each other because of a displacements in the position of the antenna.

Figure 9:
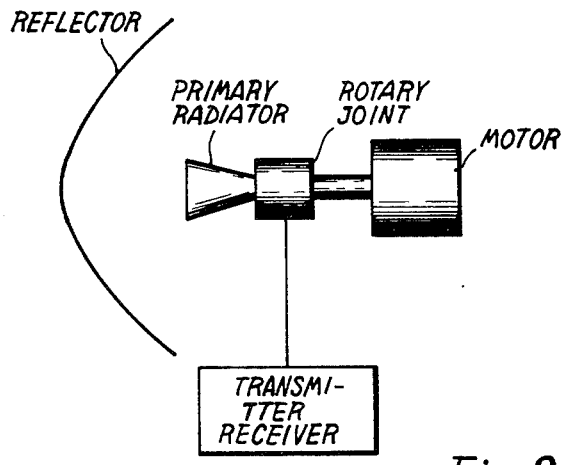
FIGS. 9 and 10 are schematic views each illustrating another example of this invention.

Moreover, for convenience of explanation, the foregoing description has been made in connection with the examples in which the antenna structure is rotated or repeatedly shifted by the mechanical mechanism. However, it is also possible to rotate or shift only a primary radiator in a case of an aperture antenna as shown in FIG. 9 or rotate or repeatedly shift a beam in cases of various electron-scanning-type antennas. It is evident that an electrical control of the antenna radiation pattern is preferable from the practical point of view as described below.

Figure 10:
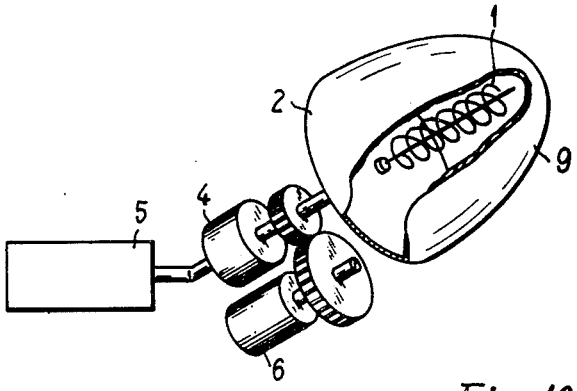

In the examples of FIGS. 2 and 7, the antenna is mechanically driven and, in this case, if the antenna is covered with a radome 9 and rotated together with the randome 9 as shown in FIG. 10, the effect of prevent ice and snow from adhering to the antenna can also be obtained together with the abovesaid effect. It is apparent that such an effect can also be produced in the case of repeatedly shifting the antenna.

Figure 11:
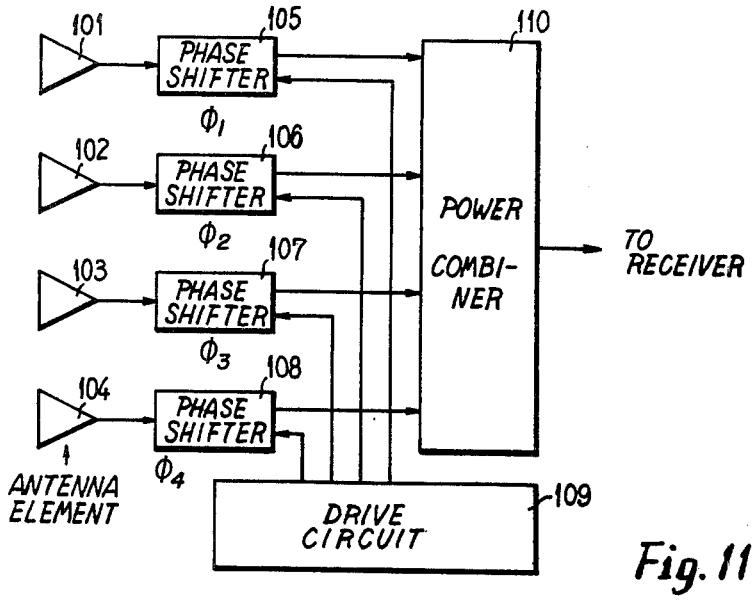
FIGS. 11 and 14 are block diagrams each illustrating a modification of a part of an antenna of this invention.

In this invention, the radiation pattern of an antenna can be electrically controlled as shown in FIG. 11, in which phase shifters 105, 106, 107 and 108 having respective phase shift angles $\phi_1$, $\phi_2$, $\phi_3$ and $\phi_4$ are respectively connected to four antenna elements 101, 102, 103 and 104 of an antenna array and controlled at a high speed by a drive circuit 109 under the predetermined principle mentioned below. The outputs of the phase shifters 105, 106, 107 and 108 are combined by a known power combiner 110 and applied to the receiver. The drive circuit 109 constitutes means for independently generating an electrical signal having a frequency higher than that of the amplitude variations superimposed on the received electromagnetic waves. The phase shifters 105–108 constitute control means responsive to the electrical signal for varying the orientation of the side lobe gain pattern.

Figure 12:
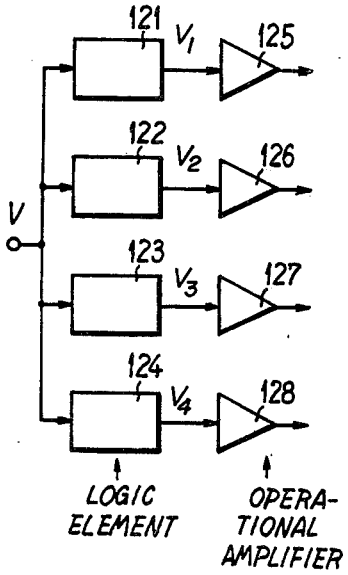
FIG. 12 is a block diagram illustrating an example of a drive circuit employed in the example shown in FIG. 11.
Figure 13A:
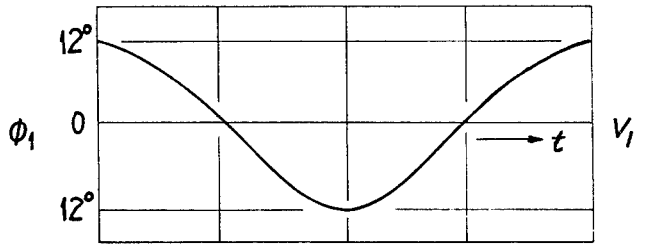
FIGS. 13A, 13B, 13C and 13D are characteristic diagrams explanatory of the operation of the example shown in FIG. 12.
Figure 13B:
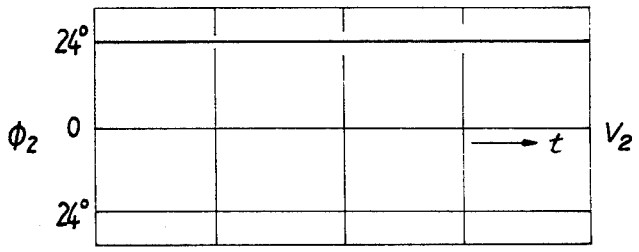
Figure 13C:
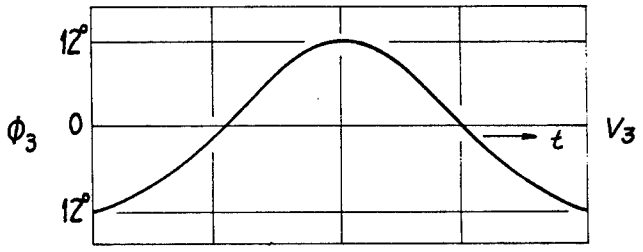
Figure 13D:
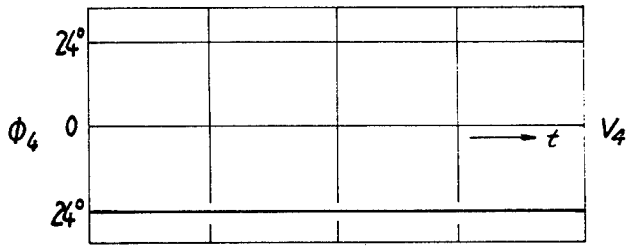

The drive circuit 109 shown in FIG. 11 can be formed, for example, as shown in FIG. 12 by four analog logic elements 121, 122, 123 and 124 and four operational amplifiers 125, 126, 127 and 128 connected respectively to the four logic elements 121, 122, 123 and 124. For example, the analog logic elements 121 and 123 generate sinnsoidal output voltages $V_1$ and $V_3$ having period T′ respectively in response to an input voltage V as shown in FIGS. 13A and 13C. The analog logic elements 122 and 124 generate constant voltages $V_2$ and $V_4$ irrespective of the value of the input voltage V. The outputs of the operational amplifiers 125, 126, 127 and 128 are respectively applied to the phase shifters 105, 106, 107 and 108 as shown in FIG. 11.

The phase shifters 105, 106, 107 and 108 can be controlled by other waveforms, such as triangular wave forms and other complicated repetitive waveforms, in addition to the above sinusoidal waveforms.

Figure 14:
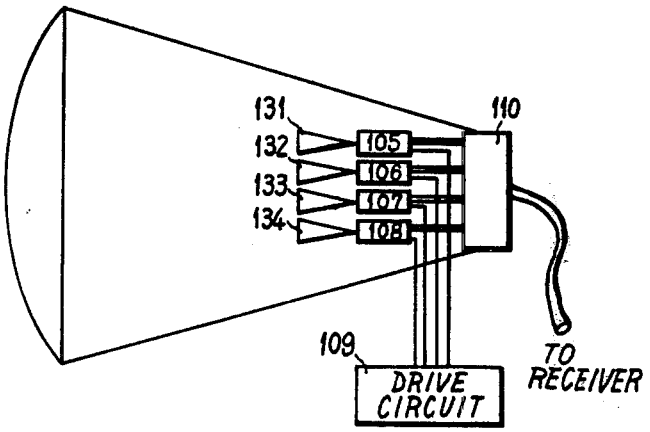

It is evident that this invention can be adapted to a reflector antenna as shown in FIG. 14, which comprises a reflector 129, a plurality of primary radiators 131, 132, 133 and 134 in addition to the phase shifters 105, 106, 107 and 108, the drive circuit 109 and the power combiner 110. The operation of this example is substantially the same as that of the example shown in FIG. 11.

As has been described above, it is possible with the present invention to obtain the electric wave transmission effect equal to or more excellent than those of the conventional diversity systems and sea surface reflected wave preventing systems by varying the radiation pattern about the beam center axis or an axis a little inclined therefrom or repeatedly shifting the above said pattern within a limited range. Moreover, by rotating or repeatedly shifting the antenna together with a radome mounted thereon, the effect of preventing adherence of ice and snow to the antenna can also be obtained.

It is apparent that this invention is applicable not only to maritime satellite communication but also to land vehicle communication and over-sea relay systems, etc.

What we claim is:

1. An antenna system, which reduces the effect of amplitude variations caused by multipath fading superimposed on electromagnetic waves transmitted over a maritime communication path and received by the antenna system, comprising: a directional antenna including a plurality of antenna elements and having a radiation pattern including a main lobe defining a direction of maximum gain for receiving electromagnetic waves in the direction of maximum gain and a side lobe gain pattern oriented in directions other than the direction of maximum gain; means for mechanically adjustably directing the direction of the maximum gain of said directional antenna to a desired direction for receiving said electromagnetic waves; means for independently generating an electrical signal having a frequency higher than that of the amplitude variations superimposed on the received electromagnetic waves and also higher than that of the transmission speed of a modulation signal of said electromagnetic waves; and control means responsive to said electrical signal for varying said radiation pattern in directions other than said direction of maximum gain at said frequency while maintaining the main lobe gain of said directional antenna in said direction of maximum gain substantially constant.

2. An antenna system according to claim 1, in which said control means comprises means for mechanically rotating the radiation pattern of said directional antenna about the structural center axis thereof.

3. An antenna system according to claim 2, in which said control means includes means for slightly inclining the center axis of the signal axis about a rotation axis.

4. An antenna system according to claim 1, in which said control means comprises means for repeatedly shifting the antenna gain pattern of said directional antenna within a predetermined shift range.

5. An antenna system according to claim 1, in which said control means comprises electric circuit means for electrically rotating the antenna gain pattern of said directional antenna about the center axis thereof.

6. An antenna system according to claim 5, in which said electric circuit means comprises a plurality of phase shifters and a drive circuit connected to said phase shifters to vary the phase shifts of the respective phase shifters according to waveforms determined by said drive circuit.

7. An antenna system according to claim 6, in which said phase shifters are connected to the outputs of antenna elements of said directional antenna.

8. An antenna system according to claim 6, in which said phase shifters are connected to the outputs of primary radiators of said single antenna.

9. A method of reducing amplitude variations caused by multipath fading in electromagnetic waves transmitted over a maritime communication path and received in a certain direction by a directional antenna having a plurality of antenna elements and having a radiation pattern including a main lobe defining a direction of maximum gain for receiving electromagnetic waves in the direction of maximum gain and a side lobe gain pattern oriented in directions other than the direction of maximum gain, said method comprising:

adjustably directing the direction of maximum gain of the directional antenna to receive electromagnetic waves in a certain desired direction; and varying the orientation of the side lobe gain pattern to vary the gain of the directional antenna in directions other that said certain desired direction at a frequency higher than that of the amplitude variations superimposed on the received electromagnetic waves while simultaneously maintaining the main lobe gain of the directional antenna in said certain desired direction substantially constant.

10. An antenna system, which reduces the effect of amplitude variations caused by multipath fading superimposed on electromagnetic waves transmitted over a maritime communication path and received by the antenna system, comprising: a directional antenna including a plurality of antenna elements and having a radiation pattern including a main lobe defining a direction of maximum gain for receiving electromagnetic waves in the direction of maximum gain and a side lobe gain pattern oriented in directions other than the direction of maximum gain; means for independently generating an electrical signal having a frequency higher than that of the amplitude variations superimposed on the received electromagnetic waves and also higher than that of the transmission speed of the modulation signal of said electromagnetic waves; and means responsive to said control signal for rotating the directional gain pattern of said directional antenna about said main lobe to change the orientation of the side lobe gain pattern at said frequency.

11. An antenna system according to claim 10, wherein said means for rotating comprise: means for mechanically rotating said directional antenna about said main lobe.

12. An antenna system, which reduces the effect of amplitude variations caused by multipath fading superimposed on received electromagnetic waves transmitted over a maritime communication path and received by the antenna system, comprising: a directional antenna including a plurality of antenna elements and having a radiation pattern including a main lobe defining a direction of maximum gain for receiving electromagnetic waves in the direction of maximum gain and a side lobe gain pattern oriented in directions other than direction of maximum gain; means for mechanically adjustably directing the direction of the maximum gain of said directional antenna to a desired direction for receiving said electromagnetic waves; and means for rotating said radiation pattern of said directional antenna around an axis of rotation at least approximately coinciding with the main lobe direction of maximum gain without varying the amplitude of the main lobe gain pattern and at a rate of rotation effective for reducing amplitude variations superimposed on the received electromagnetic waves received in the direction of maximum gain due to electromagnetic waves received by the side lobe gain pattern.

13. A method of reducing amplitude variations caused by multipath fading in electromagnetic waves transmitted over a maritime communication path and received in a certain direction by a directional antenna of the type including a plurality of antenna elements and having a radiation pattern including a main lobe defining a direction of maximum gain for receiving electromagnetic waves in the direction of maximum gain and a side lobe gain pattern oriented in directions other than the direction of maximum gain; said method comprising:

adjustably directing the main lobe direction of maximum gain of the directional antenna to receive electromagnetic waves in a certain desired direction; and rotating the radiation pattern of the directional antenna around an axis of rotation at least approximately coinciding with the main lobe direction of maximum gain without varying the amplitude of the main lobe gain pattern and at a rate of rotation effective for reducing amplitude variations superimposed on the received electromagnetic waves received in the direction of maximum gain due to electromagnetic waves received by the side lobe gain pattern.

* * * * *